United States Patent [19]

Johnson

[11] 4,168,076

[45] Sep. 18, 1979

[54] SKATEBOARD WITH TAIL BRAKE

[76] Inventor: Noel K. Johnson, 1370 Beryl, San Diego, Calif. 92109

[21] Appl. No.: 915,173

[22] Filed: Jun. 14, 1978

[51] Int. Cl.[2] ..... A63C 17/14

[52] U.S. Cl. ..... 280/11.2; 188/5; 280/87.04 A

[58] Field of Search ..... 280/11.2, 87.04 A; 188/5, 8; 280/11.1 BT, 11.1 R, 11.27, 11.21

[56] References Cited

U.S. PATENT DOCUMENTS

| | | | |
|---|---|---|---|
| 505,993 | 10/1893 | Seebick | 188/8 X |
| 892,695 | 7/1908 | Tonlinson | 188/8 |
| 2,315,342 | 3/1943 | Lieberman | 280/11.2 |
| 2,449,336 | 9/1948 | Spitzwieser | 280/87.04 R X |
| 4,037,852 | 7/1977 | Bayer et al. | 280/87.04 A |
| 4,043,566 | 8/1977 | Johnson | 280/87.04 A |
| 4,054,296 | 10/1977 | Sullins | 280/11.2 |
| 4,088,334 | 5/1978 | Johnson | 280/11.2 |

*Primary Examiner*—Joseph F. Peters, Jr.
*Assistant Examiner*—Milton L. Smith
*Attorney, Agent, or Firm*—Allen D. Brufsky

[57] ABSTRACT

A skateboard including a brake assembly for slowing and stopping the vehicle. A pivotal member on the rear of the board is provided with a depending rubber stop for engagement with the ground surface when the member is tilted by the heel of the shoe of the skater. The member is normally maintained in a raised position by a spring hinge.

5 Claims, 3 Drawing Figures

Fig. 1.
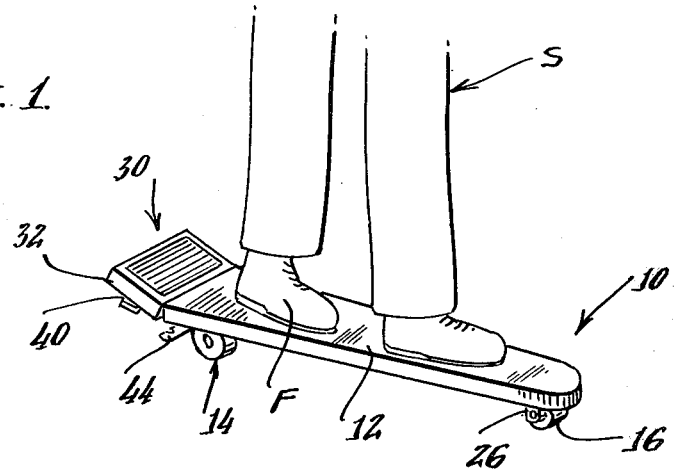
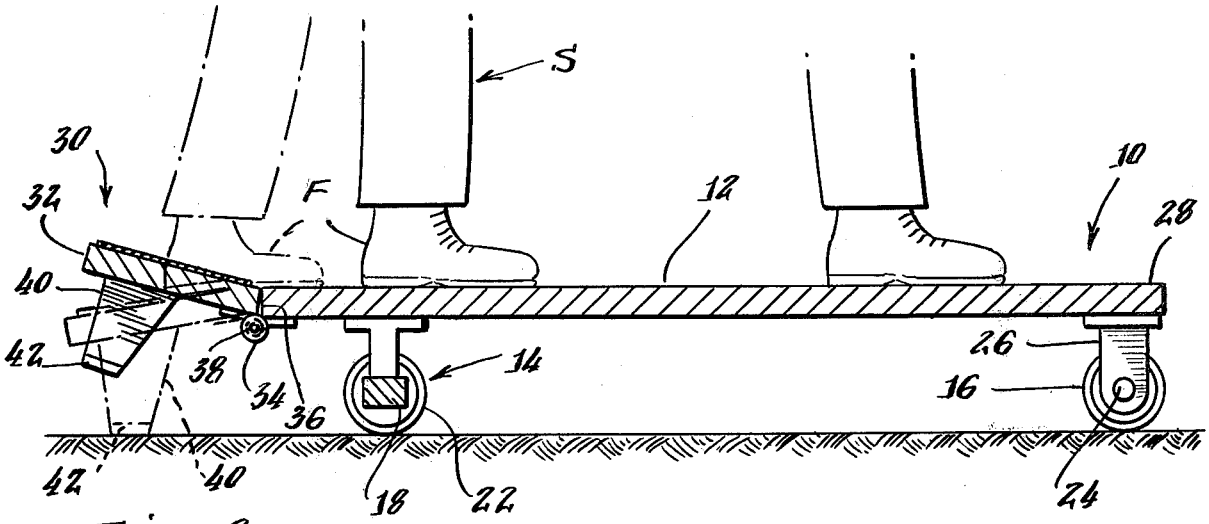
Fig. 3.
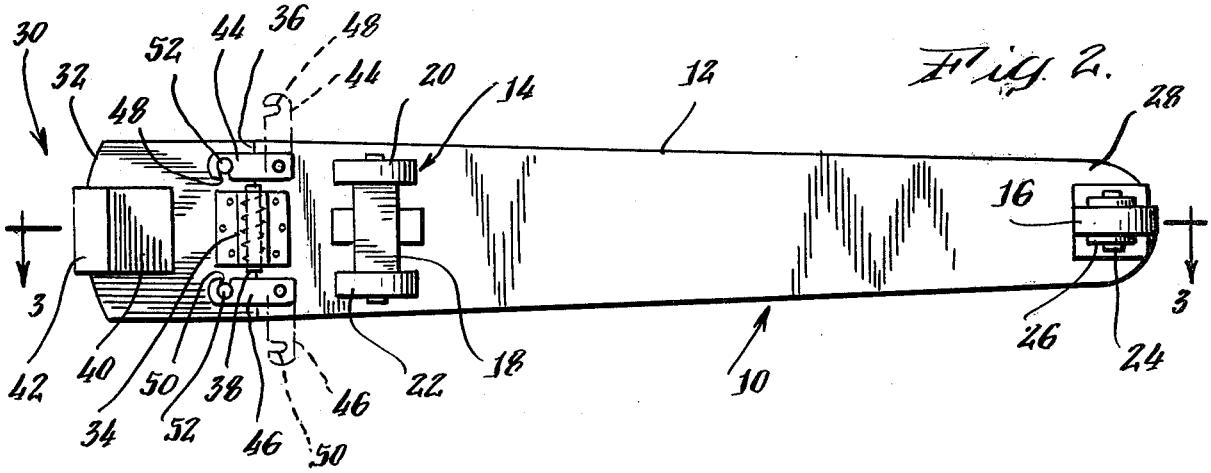
Fig. 2.

SKATEBOARD WITH TAIL BRAKE

BACKGROUND OF THE INVENTION

This invention relates to a skateboard, and more particularly, a skateboard having a novel brake assembly.

Skateboarding has become a popular sport with teenagers, sub-teenagers and also some of the more sport-sminded adults. In learning how to ride a skateboard, and even after a person becomes proficient in the use of a skateboard, it often becomes necessary to stop the board abruptly to avoid danger, as for example, when an impediment is suddenly thrust into the board's path of movement.

The only way to stop skateboards in use today, while the rider is still mounted on the board, is to drag a foot along the ground surface or dismount and let the board contact an obstruction in the path of movement. Neither method is safe.

Accordingly, in my prior U.S. Pat. No. 4,043,566, issued Aug. 23, 1977, I disclosed a skateboard with one or more brakes, which can be actuated by the foot of the mounted user to stop the skateboard. The brake assembly includes a pivotal member wholly within the confines of the board having a rubber stop for engaging the ground surface when the member is tilted by the heel of the shoe of the skater, to safely slow the board to a stop. This arrangement is somewhat awkward to actuate in that the front or balancing foot of the rider is used to depress the brake assembly.

SUMMARY OF THE INVENTION

Accordingly, the present invention provides a brake assembly on a skateboard secured to the rear edge of the board which can be actuated by the rear foot of the rider, enabling the rider to maintain his balance on the board while slowing and/or stopping the board. A pivotal member on the rear of the board is provided with a depending rubber stop for engagement with the ground surface when the member is tilted by the heel of the shoe of the skater. The member is normally maintained in a raised position by a spring hinge. When not in use, the pivotal member may be locked in a horizontal position by a hook catch pivotably mounted on the lower surface of the board.

BRIEF DESCRIPTION OF THE DRAWING

Further objects and advantages of the invention will become more apparent from the following description and claims, and from the accompanying drawing, wherein:

FIG. 1 is a perspective view of the skateboard of the present invention;

FIG. 2 is a bottom plan view of the skateboard of FIG. 1;

FIG. 3 is a cross-sectional view taken substantially along the plane indicated by line 3—3 of FIG. 2.

DETAILED DESCRIPTION OF THE PREFERRED EMBODIMENT

Referring now to the drawing in detail, wherein like numerals indicate like elements throughout the several views, the numeral 10 generally designates a conventional form of skateboard including an elongated, tapered, panel-like body 12 having a rear depending wheel truck 14 and a single front depending wheel 16.

The rear truck 14 includes the usual pivotally supported axle assembly 18 having dual wheels 20 and 22 journaled thereon. Front wheel 16 is journaled on an axle 24 supported by brackets 26 attached to the tip 28 of skateboard 10.

A brake assembly 30 is provided on skateboard 10 to slow and stop the skateboard, as desired, by a mounted skater S. Brake assembly 30 includes a pivotal member 32 mounted by a spring hinge 34 to the rear edge 36 of skateboard 10. Member 32 is tiltable by the heel of the foot F of skater S about a hinge pin 38, against the bias of the spring wound about the pin 38 from the full line to the ground engaging phantom line position shown in FIG. 3. Spring hinge 34 normally retains member 32 at an obtuse angle with the plane panel-like body 12.

Depending from the rear bottom surface of member 32 is a wooden block 40 having a rubber stop 42. Block 40 is in the shape of a truncated tetrahedron and when member 32 is tilted in a counterclockwise direction, as viewed in FIG. 3, stop 42 will engage the ground surface to act as a brake for skateboard 10, as shown by the phantom lines in FIG. 3.

In use, the skater S mounts skateboard 10 with both feet on the board and coasts down an incline. The heel of foot F is positioned on the rear portion of panel 12. The top surface of member 32 can be provided with a rubber pad to increase the friction between the shoe on foot F and member 32. If it is desired to slow skateboard 10 or stop it completely, skater S tilts member 32 about hinge 34 with his rear foot so rubber stop 42 will drag along the ground surface. Otherwise, member 32 is retained in its normal upright position by the spring wound about hinge pin 38.

The brake assembly may be inactivated and skateboard 10 stored by pivoting a pair of hook catches 44 and 46, pivotably mounted on the bottom surface of the tapered body 12 across the rear edge 36. The hooks 48 and 50, respectively, are each frictionally engaged and attached to a pintle 52 extending downwardly from the bottom surface of member 32 to lock the member 32 in a horizontal position.

What is claimed is:

1. A skateboard comprising:

a low elongated substantially horizontal body having a front and a rear end, front and rear ground engaging support wheel means carried by corresponding end portions of said body, the latter being adapted to support a load thereon, and brake means on said body for slowing said body by engagement with the ground in response to pivotal movement thereof by the load supported on said body, said brake means including a substantially planar member, spring hinge means for pivotably connecting said member to the rear end of said horizontal body and biasing said member upwardly relative to said horizontal body, a depending stop on the rear portion of said planar member for engaging the ground upon pivoting said planar member against the bias of said spring hinge means, at least one hook catch pivotably mounted on the bottom surface of said horizontal body adjacent the rear end thereof, and at least one pintle on the bottom surface of said planar member adapted to cooperate with said hook catch to lock said planar member by precluding pivotal movement thereof.

2. A skateboard in accordance with claim 1 wherein said stop member is rubber.

3. A skateboard in accordance with claim 1 wherein said stop member is a truncated tetrahedron.

4. A skateboard in accordance with claim 1 wherein said stop member is formed from friction generating material.

5. A skateboard in accordance with claim 1 wherein said planar member includes a rubber pad on its upper surface.

* * * * *